US007522707B2

(12) United States Patent
Steinlage et al.

(10) Patent No.: US 7,522,707 B2
(45) Date of Patent: Apr. 21, 2009

(54) X-RAY SYSTEM, X-RAY APPARATUS, X-RAY TARGET, AND METHODS FOR MANUFACTURING SAME

(75) Inventors: Gregory Alan Steinlage, Hartland, WI (US); Thomas Carson Tiearney, Jr., Waukesha, WI (US); Michael Scott Hebert, Muskego, WI (US); Paul Alfred Siemers, Clifton Park, NY (US); Kirk Alan Rogers, Chagrin Falls, OH (US); Ray Alden Henrichsen, Burton, OH (US)

(73) Assignee: General Electric Company, Schenectady, NY (US)

( * ) Notice: Subject to any disclaimer, the term of this patent is extended or adjusted under 35 U.S.C. 154(b) by 36 days.

(21) Appl. No.: 11/555,729

(22) Filed: Nov. 2, 2006

(65) Prior Publication Data

US 2008/0107238 A1 May 8, 2008

(51) Int. Cl.
*H01J 35/10* (2006.01)

(52) U.S. Cl. ..... 378/144; 378/125; 378/143

(58) Field of Classification Search ..... 378/119–144
See application file for complete search history.

(56) References Cited

U.S. PATENT DOCUMENTS 3,136,907 A * 6/1964 Kieffer et al. ..... 378/144
3,622,824 A * 11/1971 Atlee ..... 378/128
5,222,116 A * 6/1993 Eloff et al. ..... 378/143
6,390,876 B2 * 5/2002 Benz et al. ..... 445/28
6,428,904 B2 * 8/2002 Hasz et al. ..... 428/553
6,487,275 B1 * 11/2002 Baba et al. ..... 378/144
7,286,643 B2 * 10/2007 Hebert et al. ..... 378/125
7,313,226 B1 * 12/2007 Falce et al. ..... 378/143

FOREIGN PATENT DOCUMENTS

EP 359865 A1 * 3/1990

* cited by examiner

*Primary Examiner*—Edward J Glick
*Assistant Examiner*—Thomas R Artman
(74) *Attorney, Agent, or Firm*—Peter Vogel, Esq.; William Baxter, Esq.; Michael G. Smith, Esq.

(57) ABSTRACT

In some embodiments, an X-ray target includes a target cap formed of a substrate material and a focal track layer of emitting material, and at least one of the substrate material and the emitting material has a density greater than about 95.0% of theoretical density. In some embodiments, a method of manufacturing an X-ray target includes forming an intermediate target cap form of substrate material and a focal track layer of emitting material, and compacting the intermediate target cap form by application of gas pressure at elevated temperature to form a final target cap form, and at least the substrate material is dense substrate material having a final density greater than an intermediate density or the emitting material is dense emitting material having a final emitting material density greater than an intermediate emitting material density.

20 Claims, 9 Drawing Sheets

METHOD 500

METHOD 600

METHOD 800

METHOD 900

X-RAY SYSTEM, X-RAY APPARATUS, X-RAY TARGET, AND METHODS FOR MANUFACTURING SAME

FIELD OF THE INVENTION

The disclosure relates generally to X-ray imaging systems, X-ray apparatus and X-ray targets. The disclosure also relates to methods for manufacturing X-ray systems, X-ray apparatus and X-ray targets.

BACKGROUND OF THE INVENTION

X-ray imaging systems typically include an X-ray apparatus operable to generate a beam of X-rays, a detection apparatus, and a control system connected to the X-ray apparatus and detection apparatus. The X-ray apparatus produces a beam of X-rays which interact with a subject and are detected by operation of the detection apparatus. One typical example of an X-ray imaging system is a high performance computed tomography (CT) X-ray imaging system, which accommodates a human subject for medical imaging. Medical X-ray imaging systems typically include a gantry which is movable in relation to the human subject.

X-ray apparatus typically include an X-ray tube which is operable to generate a beam of X-rays. A typical X-ray tube includes a housing which forms an evacuated chamber. The housing supports inside the chamber a cathode assembly with a cathode filament. A high voltage electrical circuit is formed between the cathode and an anode assembly supported inside the housing. The anode assembly includes an X-ray target spaced from the cathode filament. The X-ray target includes a generally disk-shaped target cap. The target cap is formed of a high conductivity refractory metal, such as an alloy of molybdenum. An annular focal track on the front surface of the target cap includes a suitable X-ray emitting material, such as a chemical species of high atomic weight, of a type which interacts with high energy electrons to emit X-rays. The X-ray target also includes a heat sink affixed to a rear surface of the target cap. The heat sink receives intense heat conducted away from the focal track and substrate. Typically, the heat sink is formed of an annular block of graphite brazed to the rear surface of the target cap. The target cap is supported for rotation about a longitudinal axis. High speed rotation of the X-ray target is driven by a rotor connected to a drive motor.

For an imaging scan, the electrical circuit energizes the cathode filament to generate high energy electrons which impinge upon the focal track of the X-ray target. Interactions between the electrons and high atomic weight species in the focal track emit high frequency electromagnetic waves, or X-rays. X-rays directed through a window in the chamber housing are focused on a subject for imaging purposes. The electron interactions release intense heat into the focal track and target cap. The X-ray target is rotated by the motor at high speed in order to avoid overheating. Heat is also conducted out of the focal track into the substrate, and then into the heat sink. Heat dissipates from the heat sink through evacuated space in the chamber and into the housing. The housing is cooled by immersion in an external fluid bath.

Conventional X-ray targets presently possess material densities ranging from about 90.0% to about 95.0% of theoretical density. X-ray targets possessing material densities ranging from about 90.0% to about 95.0% of theoretical density are hindered by remaining porosity and porosity variation. X-ray targets can be produced by a "PSF" method by cold pressing (P) a form of substrate material and X-ray emitting material, sintering (S) the cold pressed form, and forging (F) the sintered form to desired shape. X-ray targets produced by the PSF method can possess material densities ranging from about 90.0% to about 95.0% of theoretical density. X-ray targets produced by the PSF method can be hindered by limited density, density variations, remaining porosity, porosity variations, limited mechanical strength properties, variation of mechanical strength properties, limited thermal conductivity, limited thermo-mechanical properties, limited thermal loading capacity, limited mechanical loading capacity. Examples of specific properties limited by the foregoing include: resistance to creep, tensile strength, compressive strength, thermal conductivity, bulk modulus, yield strength, mass per unit diameter, X-ray target diameter, thermal durability per unit of mass, mechanical durability per unit of mass, fatigue resistance, resistance to fatigue crack growth, resistance to crack growth, focal track life, and focal track performance. X-ray apparatus including X-ray targets having the foregoing limitations are hindered by limited capacity to operate at peak power, limited X-ray target rotation speed, limited gantry rotation speed, limited X-ray output at peak power, limited frequency of exposures at peak power, longer cooling periods between exposures, and limited cycle rate.

The specified limitations of X-ray targets produced by the PSF method can worsen as diameter of the X-ray target increases. Targets produced by the PSF method can suffer CTE mismatched bending stress or warpage because of differences between material properties of the focal track and the substrate material supporting the focal track. X-ray targets produced by the PSF method are hindered by the limitation that microstructure of the substrate and focal track materials is not highly controlled and, thus, variations of material properties such as microstructure and variation of microstructure are not optimal and are subject to great variation.

For reasons stated above and for other reasons which will become apparent to those skilled in the art upon reading and understanding the present specification, there is a need in the art for improved X-ray targets, X-ray apparatus, and X-ray imaging systems, and for improved methods of manufacturing the same.

BRIEF DESCRIPTION OF THE INVENTION

The above-mentioned shortcomings, disadvantages and problems are addressed herein, as will be understood by those skilled in the art upon reading and studying the following specification.

In one aspect, systems, apparatus, and methods are provided through which X-ray imaging systems, X-ray apparatus, X-ray tubes, anode assemblies, and X-ray targets include a target cap formed of substrate material and a focal track layer formed of emitting material, and at least one of the substrate material and the emitting material has a density greater than about 95.0% of theoretical density.

In one aspect, systems, apparatus and methods are provided through which an X-ray target includes a target cap formed of substrate material and a focal track layer of emitting material, and at least one of the substrate material is dense substrate material having a final density greater than an intermediate density, or the emitting material is dense emitting material having a final emitting material density greater than an intermediate emitting material density.

Apparatus, systems, and methods of varying scope are described herein. In addition to the aspects and advantages described in this summary, further aspects and advantages will become apparent by reference to the following drawings, detailed description and claims.

DETAILED DESCRIPTION OF THE INVENTION

In the following detailed description, reference is made to the accompanying drawings which form a part hereof, and in which is shown by way of illustration specific embodiments which may be practiced. These embodiments are described in sufficient detail to enable those skilled in the art to practice the embodiments and disclosure. It is to be understood that other embodiments may be utilized, and that logical, mechanical, electrical, and other changes may be made without departing from the scope of the embodiments and disclosure. In view of the foregoing, the following detailed description is not to be taken as limiting the scope of the embodiments or disclosure.

Figure 1:
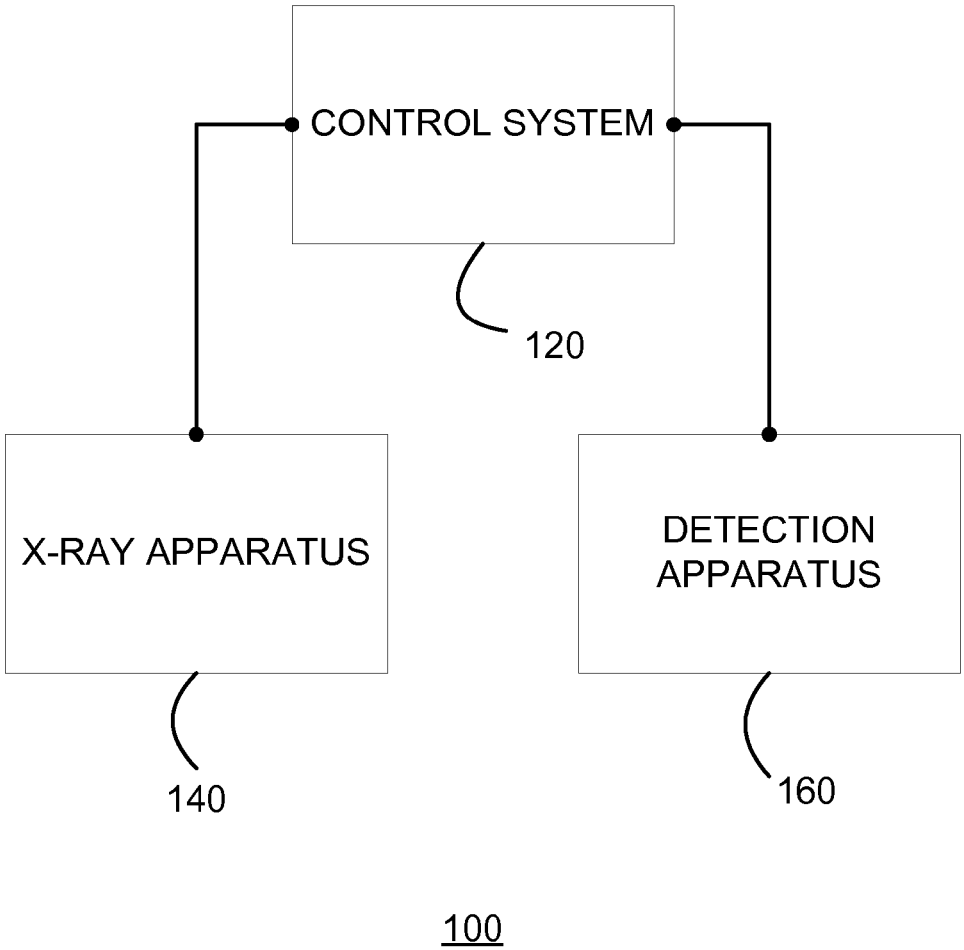
FIG. 1 is a simplified block diagram of an X-ray imaging system 100 according to an embodiment.

Illustrated in FIG. 1 is a simplified block diagram of an X-ray imaging system 100 according to an embodiment. It is to be understood that an X-ray imaging system 100 according to embodiments of the disclosure can have different arrangements other than the specific representation illustrated in FIG. 1. One example of an X-ray imaging system 100 according to an embodiment is a computed tomography (CT) X-ray imaging system for imaging a human subject. Other specific arrangements of an X-ray imaging system 100 according to embodiments are contemplated. Examples of other embodiments include arrangements for various medical imaging uses and for examination of baggage, containers and other objects.

X-ray imaging system 100 includes a control system 120. X-ray imaging system 100 also includes an X-ray apparatus 140. X-ray apparatus 140 is connected to control system 120 and is operable to generate a beam of X-rays for imaging a subject (not shown). X-ray imaging system 100 also includes a detection apparatus 160. Detection apparatus 160 is connected to control system 120 and is operable to detect X-rays which can interact with the subject (not shown). In some specific arrangements, the X-ray apparatus 140 may include a movable gantry (not shown) connected to the control system 120 and operable for movement along a prescribed path.

Figure 2:
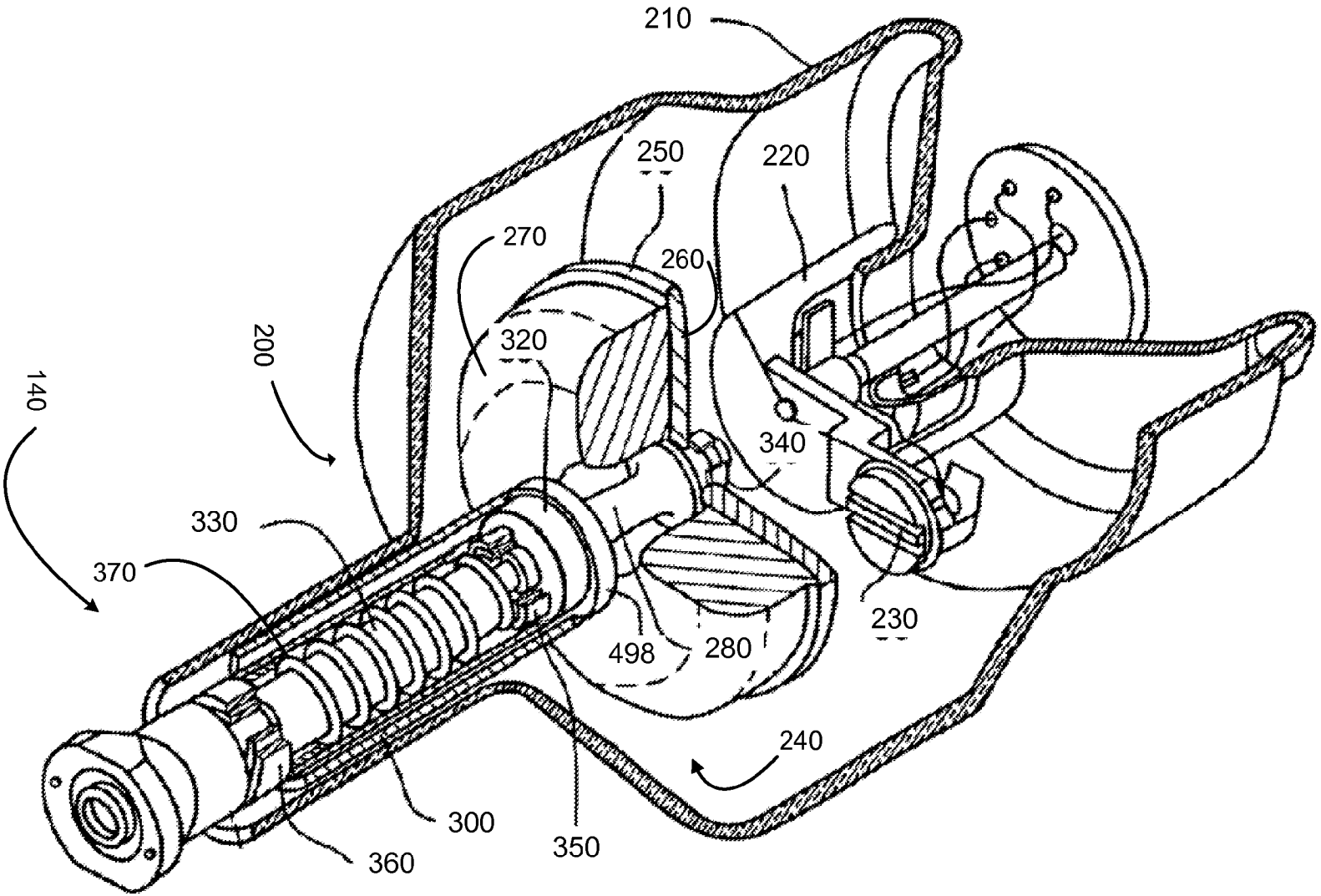
FIG. 2 is a partial perspective view of an X-ray apparatus 140 according to an embodiment, with parts broken away, parts in section, and parts omitted.

Illustrated in FIG. 2 is a partial perspective view of an X-ray apparatus 140 according to an embodiment, with parts broken away, parts in section, and parts omitted. It is to be understood by those skilled in the art that, for clarity, various elements have been omitted from FIG. 2. X-ray apparatus 140 can have different arrangements other than the specific representation illustrated in FIG. 2. In the specific arrangement illustrated in FIG. 2, the X-ray apparatus 140 includes an X-ray tube 200. It is to be understood that X-ray apparatus 140 according to an embodiment can include, in addition to the illustrated X-ray tube 200, additional elements (not shown in FIG. 2) known by those skilled in the art and which cooperate with X-ray tube 200 to generate X-rays for imaging a subject.

The X-ray tube 200 includes a glass or metal envelope or housing 210. Inside the housing 210 exists a vacuum or evacuated space having a reduced pressure of about 10.sup.−5 to about 10.sup.−9 torr. A cathode assembly 220 including a cathode filament 230 is supported inside the housing 210. The cathode filament 230 is connected to a selectively operable electrical circuit (not shown). The electrical circuit is connected to an anode assembly 240 supported inside the housing 210. The anode assembly 240 includes an X-ray target 250 spaced a fixed distance from the cathode assembly 220 along a longitudinal axis 255 (see FIG. 3). Referring to FIG. 4, the electrical circuit is selectively operable to cause a voltage potential between the cathode filament 230 and anode assembly 240 which generates high energy electrons directed at the X-ray target 250. X-ray target 250 includes a target cap 260 having a disk portion 265 and a rear surface 277, as further described below. A heat sink 270 is affixed to the rear surface 277 of target cap 260 to dissipate heat. X-ray target 250 and target cap 260 also include a stem 280 supporting the disk portion 265, as further described below. The stem 280 is connected to a rotor 300 by a rotor hub 320. Rotor 300 is connected to a motor (not shown) and drives rotation of the target cap 260 about longitudinal axis 255. Target cap 260 is secured to a rotational shaft 330 by a fastener 340. Rotational shaft 340 is operatively supported by a front bearing 350 and rear bearing 360. A preloaded spring 370 is positioned about the rotational shaft 330 between the front bearing 350 and rear bearing 360 for maintaining load on the bearings 350, 360 during thermal expansion and contraction of the anode assembly 240.

Figure 3:
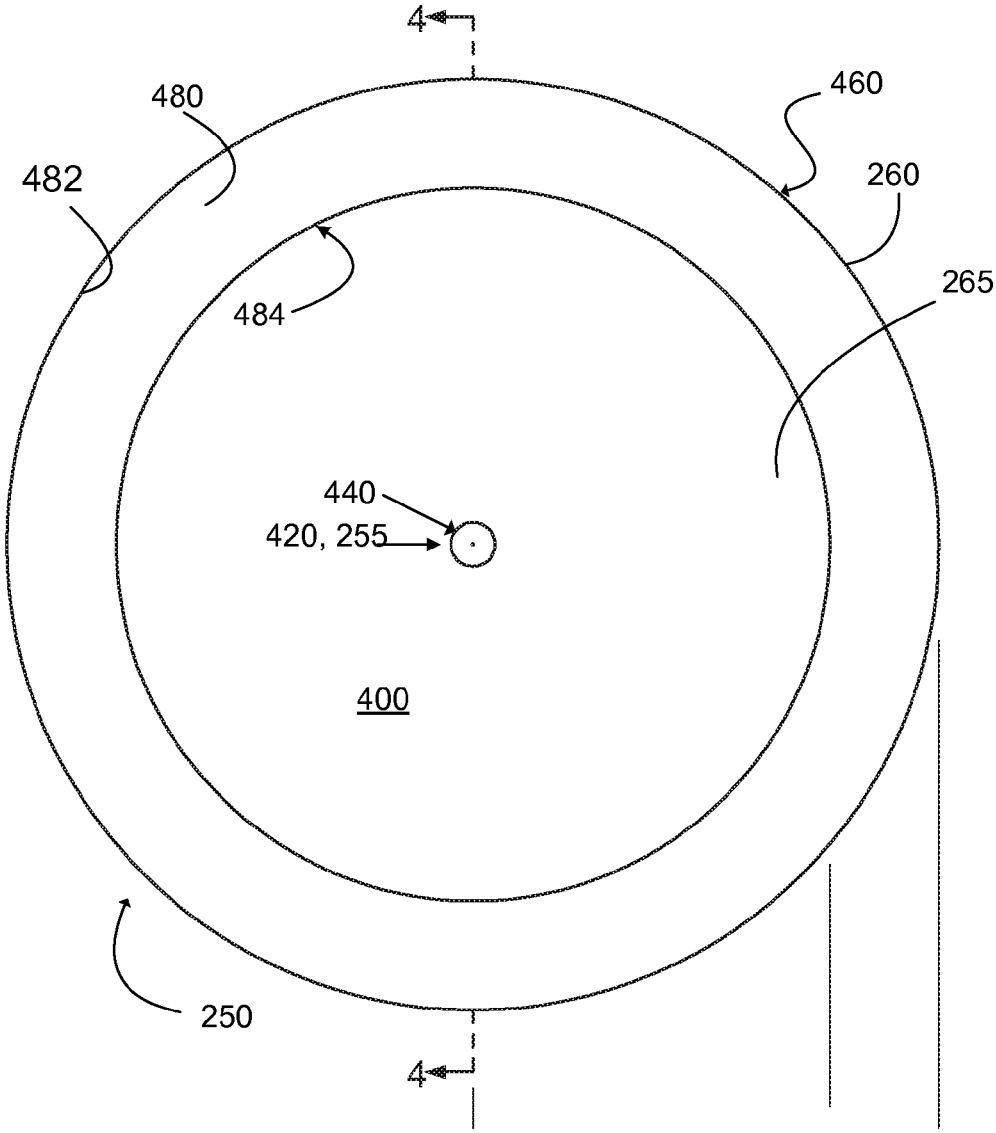
FIG. 3 is a front elevation view of the X-ray target 250 (shown generally in FIG. 2) according to an embodiment.
Figure 4:
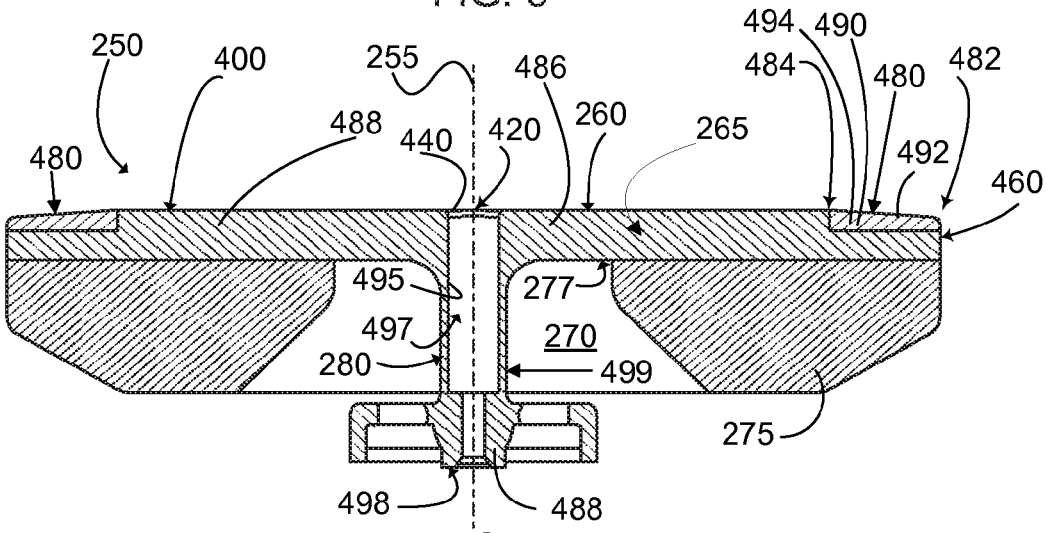
FIG. 4 is a cross section of the X-ray target 250 taken generally along line 4-4 in FIG. 3.

FIG. 3 is a front elevation view of the X-ray target 250 (shown generally in FIG. 2) according to an embodiment. The X-ray target 250 includes the generally disk-shaped target cap 260. Viewed along longitudinal axis 255, target cap 260 includes a disk portion 265 having a circular front surface 400 facing the cathode assembly 220 and cathode filament 230 (not shown in FIG. 3). The front surface 400 has therein a center 420 at longitudinal axis 255. The front surface 400 has therein a central hole 440 concentric with the center 420. The front surface 400 is symmetrical about center 420 and includes a continuous outer edge 460. Outer edge 460 is spaced outwardly from the center 420 in a radial direction and thus defines an outer radius. The front surface 400 includes an annular focal track 480. The focal track 480 has a continuous outer focal track edge 482. In the illustrated arrangement, the outer focal track edge 482 is defined by the outer edge 460. The outer focal track edge 482 is spaced outwardly from the center 420 in the radial direction and thus defines an outer focal track radius. The focal track 480 also has a continuous inner focal track edge 484 intermediate the center 420 and outer focal track edge 482. The inner focal track edge 484 is spaced outwardly from the center 420 in the radial direction and thus defines an inner focal track radius. The focal track 480 defined between the inner focal track edge 484 and outer focal track edge 482 is an annulus. In the illustrated arrangement, the inner focal track edge 484 is closer to the outer edge 460 than the center 420, such that the annular focal track 480 is adjacent the outer edge 460.

FIG. 4 is a cross section of X-ray target 250 taken generally along line 4-4 in FIG. 3. Referring to FIG. 4, X-ray target 250 includes the target cap 260 formed of substrate material 486. In an embodiment, substrate material 486 is a suitable high conductivity refractory metal. For example, in an embodiment, substrate material 486 is formed of molybdenum, compositions including molybdenum, alloys of molybdenum, compositions including alloys of molybdenum, tungsten or alloys of tungsten. In one embodiment, the substrate material 486 is formed of TZM molybdenum alloy containing small amounts of titanium, zirconium and carbon, oxide-dispersion strengthened molybdenum alloy (ODS-Mo), or other carbide-dispersion strengthened alloys. In one embodiment, the substrate material 486 includes a high conductivity refractory metal selected from molybdenum, compositions including molybdenum, alloys of molybdenum, compositions including alloys of molybdenum, tungsten, compositions including tungsten, alloys of tungsten, and compositions including alloys of tungsten.

According to one embodiment, the substrate material 486 is dense substrate material 488. According to an embodiment, dense substrate material 488 has a density greater than or equal to about 95.0% of theoretical density. According to one embodiment, dense substrate material 488 has a density greater than or equal to about 96.0% of theoretical density. According to one embodiment, dense substrate material 488 has a density greater than or equal to about 97.0% of theoretical density. According to one embodiment, dense substrate material 488 has a density greater than or equal to about 98.0% of theoretical density. According to one embodiment, dense substrate material 488 has a density greater than or equal to about 99.0% of theoretical density. As used herein, "density" means the minimum density within the subject material.

Referring to FIG. 4, the focal track 480 is formed of emitting material 490. Emitting material 490 is suitable material known to emit X-rays upon interacting with high energy electrons. According to one embodiment, emitting material 490 is one of a group of chemical species of high atomic number and high melting temperature, which are known to emit X-rays. Examples of suitable emitting material 490 include tungsten and alloys of tungsten. In one specific embodiment, the emitting material 490 is a tungsten-rhenium alloy.

The focal track 480 is formed of emitting material 490 in a focal track layer 620 on the front surface 400 of the substrate material 486. Focal track layer 492 extends between the inner focal track edge 484 and outer focal track edge 482 in an annulus on the front surface 400. The focal track layer 492 of emitting material 490 is formed on the front surface 400 of the dense substrate material 488 in a suitable manner. In one embodiment, the focal track layer 492 is formed by depositing the emitting material 490 on the substrate material 486 by powder coating, plasma spraying, electroplating, chemical vapor deposition or physical vapor deposition.

According to one embodiment, the emitting material 490 is dense emitting material 494. According to one embodiment, dense emitting material 494 has a density greater than or equal to about 95.0% of theoretical density. According to one embodiment, dense emitting material 494 has a density greater than or equal to about 96.0% of theoretical density. According to one embodiment, dense emitting material 494 has a density greater than or equal to about 97.0% of theoretical density. According to one embodiment, dense emitting material 494 has a density greater than or equal to about 98.0% of theoretical density. According to one embodiment, dense emitting material 494 has a density greater than or equal to about 99.0% of theoretical density. As used herein and specified above, "density" means the minimum density within the subject material.

Referring to FIG. 4, central hole 440 in the front surface 400 is defined by intersection of continuous inner wall 495 with front surface 400. Inner wall 495 extends along longitudinal axis 255 in parallel spaced relation thereto and thus defines an open cavity 497. Open cavity 497 accommodates the rotational shaft 340. Inner wall 495 reduces diameter in stem 280 and terminates at stem hub 498. Stem 280 has an outer stem wall 499 which returns from the stem hub 498 and intersects the rear surface 277. In the embodiment illustrated in FIG. 4, stem 280 is integrally and continuously formed of the same substrate material 486 forming target cap 260. In one embodiment, stem 280 is integrally formed of the same dense substrate material 488 forming target cap 260. In one embodiment (not shown), the stem 280 is initially formed of separate material from the substrate material 486, and is then joined with the substrate material 486 by a known method, such as welding. According to an embodiment, welding includes friction welding, inertia welding, and brazing.

The rear surface 277 of target cap 260 is generally parallel and in spaced opposition to front surface 400. Heat sink 270 is integrally affixed to rear surface 277 in thermal communication with dense substrate material 488. The heat sink 270 receives intense heat conducted away from the focal track 480 and front surface 400 through the dense substrate material 488. In one embodiment, the heat sink 270 is formed of an annular block of graphite 275. In one embodiment, the heat sink 270 is formed of suitable material having sufficiently high heat capacity and thermal emission to rapidly dissipate intense heat and sufficient mechanical strength to endure high speed rotation through repeated heating and cooling cycles. In one embodiment, the heat sink 270 is integrally affixed to the rear surface 277 by brazing. In one embodiment, the heat sink 270 is integrally affixed to the rear surface 277 by diffusion bonding.

Embodiments of the disclosure provide an X-ray imaging system 100, X-ray apparatus 140, X-ray tube 200, anode assembly 240, X-ray target 250 and target cap 260 as follows. An embodiment provides an X-ray target including a target cap having increased mechanical strength without decreased thermal conductivity. An embodiment provides an X-ray target including a target cap having increased mechanical strength and increased thermal conductivity. An embodiment provides an X-ray target including a target cap having increased tensile strength. An embodiment provides an X-ray target including a target cap having increased resistance to creep. An embodiment provides an X-ray target including a target cap having reduced porosity. An embodiment provides an X-ray target including a target cap having reduced variations of porosity. An embodiment provides an X-ray target including a target cap having increasingly consistent mechanical properties. An embodiment provides an X-ray target including a target cap having improved thermal and mechanical life per unit of mass. An embodiment provides an X-ray target including a target cap having improved capacity to endure increased thermal and mechanical loading. An embodiment provides an X-ray target including a target cap having reduced mass per unit diameter. An embodiment provides an X-ray target including a target cap having increased capacity to operate at increased peak power, and thus to produce an increased output of X-rays at peak power. An embodiment provides an X-ray target including a target cap having increased capacity to operate with more frequent exposures at peak power and shorter cooling periods between exposures. An embodiment provides an X-ray target including a less massive target cap capable of enduring increased rotation speeds and potentially being of greater diameter. An embodiment provides an X-ray target including a target cap capable of enduring increased gantry rotation speeds. An embodiment provides an X-ray target including a target cap of improved bulk modulus. An embodiment provides an X-ray target including a target cap of increased yield strength. An embodiment provides an X-ray target including a target cap of increased fatigue resistance. An embodiment provides an X-ray target including a target cap of increased resistance to fatigue crack growth. An embodiment provides an X-ray target including a target cap having emitting material of increased resistance to fatigue crack growth in the focal track layer. An embodiment provides an X-ray target including a target cap having substrate material of increased resistance to fatigue crack growth in the substrate material. An embodiment provides an X-ray target including a target cap having emitting material of increased resistance to fatigue crack growth in the axial direction in the focal track layer. An embodiment provides an X-ray target including a target cap having substrate material of increased resistance to fatigue crack growth in the axial direction in the substrate material. An embodiment provides an X-ray target including a target cap of increased resistance to crack growth. An embodiment provides an X-ray target including a target cap having emitting material of increased resistance to crack growth in the focal track layer. An embodiment provides an X-ray target including a target cap having substrate material of increased resistance to crack growth in the substrate material. An embodiment provides an X-ray target including a target cap having emitting material of increased resistance to crack growth in the axial direction in the focal track layer. An embodiment provides an X-ray target including a target cap having substrate material of increased resistance to crack growth in the axial direction in the substrate material. An embodiment provides an X-ray target including a target cap of increased thermal conductivity. An embodiment provides an X-ray target including a target cap having increased focal track life. An embodiment provides an X-ray target including a target cap having increased focal track performance. An embodiment provides an X-ray target including a target cap having reduced radiation output losses over the life of the X-ray target. An embodiment provides an X-ray target including a target cap having reduced surface roughening over the life of the X-ray target.

An embodiment of the disclosure provides various improvements, benefits, advantages, features and solutions which will be described in further detail, as follows. X-ray targets in X-ray imaging systems such as computed tomography (CT) systems can be formed with a relatively large diameter target cap and focal track in order to accommodate increased peak power loads and thus provide increased X-ray output and image resolution. The diameter of X-ray targets can be limited by mechanical factors, such as limitations of the mechanical strength, thermal conductivity, and thermo-mechanical durability of the target cap substrate material and emitting material. In X-ray imaging systems such as computed tomography (CT) systems, a gantry rotates at approximately three revolutions per second around a patient and an anode assembly including the X-ray target rotates at approximately 100 to 200 revolutions per second. These rotations create large forces on the X-ray target and target cap that increase exponentially as the diameter and mass of the target cap and X-ray target increase. X-ray targets in X-ray imaging systems can also have a limiting mechanical factor in the thermal conductivity of the target cap substrate material and emitting material. The target cap substrate material and emitting material must be able to conduct heat at specified rates in order to be capable of emitting X-ray energy at a related minimum rate. Limits on the rate of emitting X-ray energy in turn limits the maximum number of imaging scans per unit of time, or usage rate, at which X-ray images can be made by the X-ray imaging system, and thus limits the usefulness of such X-ray imaging systems. During periods of continuous usage of some systems, the maximum usage rate at peak power can also be limited by the length of time required between exposures to adequately dissipate heat from the anode assembly. Operating an X-Ray system repeatedly or continuously at or in excess of the maximum usage rate can cause premature failure of X-ray tube components, especially the X-ray target. Temperatures reached in adjoining components decreases as those components are located increasingly distant from the focal track. Additionally, in order to rapidly dissipate heat from the heat sink, it is effective to rotate the X-ray target at high speed. However, other limitations frequently are prohibitive of continuously rotating the X-ray target in order to dissipate heat. In ordinary use, if the X-ray target and rotor were allowed to continue to rotate between exposures, the bearings would wear rapidly and fail prematurely. Thus, under certain circumstances of ordinary use dictating an excessive time delay between exposures, the X-ray system control system rapidly slows or stops the rotor and X-ray target in a period of seconds. When ready to initiate a scan, the control system returns the rotor and X-ray target to operational rotation speed as quickly as possible. Rapid acceleration and rapid deceleration are utilized because, among other reasons, there are a number of resonant frequencies that must be avoided during acceleration and braking. During such rapid acceleration and rapid braking, mechanical stresses and thermal stresses impact the components of the anode assembly. Embodiments of the disclosure provide X-ray imaging systems, X-ray apparatus, anode assemblies, X-ray targets, target caps, and methods for producing the same, having improvements, benefits, advantages, features and solutions which address the foregoing issues.

Method Embodiments

In the previous section, apparatus embodiments were described. In the present section, and by reference to the accompanying series of flowcharts, are described methods for manufacturing X-ray targets according to embodiments of the disclosure. It is to be understood that embodiments other than those specifically described herein are possible. It is to be understood that methods according to embodiments provide X-ray imaging systems, X-ray apparatus, X-ray tubes, anode assemblies, and X-ray targets having the same features, improvements and benefits described above in reference to the apparatus embodiments. It will be understood by those skilled in the art that X-ray targets are readily manufactured using target caps produced by methods according to the embodiments. It is to be understood that methods according to the embodiments can readily be adapted by one skilled in the art to produce target caps, X-ray targets, anode assemblies, X-ray tubes, X-ray apparatus and X-ray imaging systems.

Figure 5:
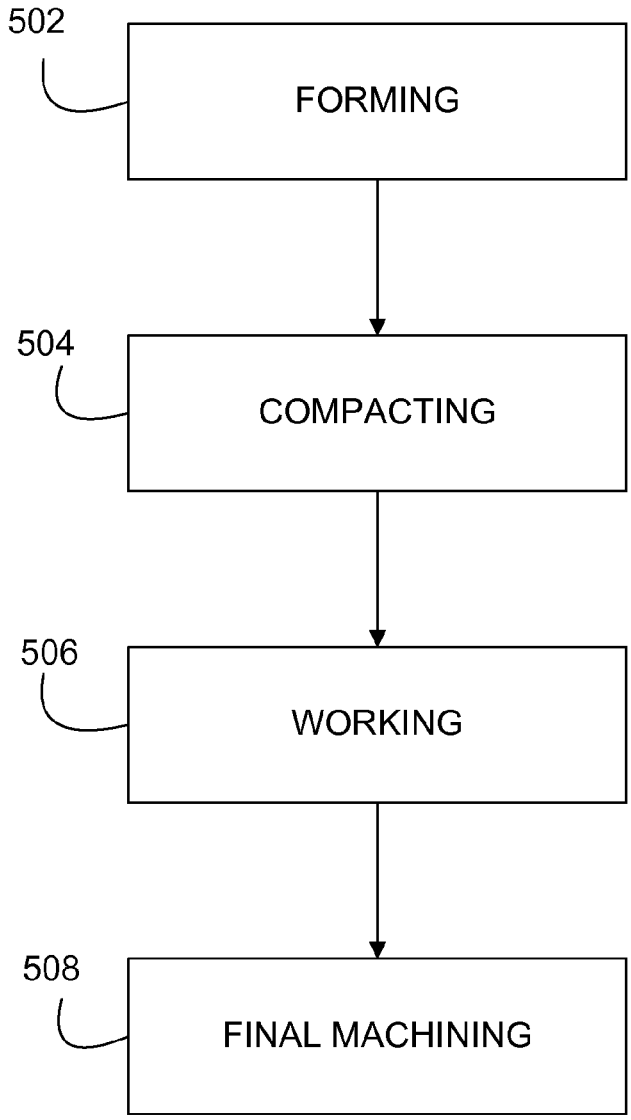
FIG. 5 is a flowchart illustrating a Method 500 for producing an X-ray target according to an embodiment.
Figure 5:
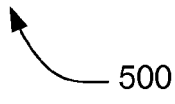

FIG. 5 is a flowchart illustrating a method 500 to manufacture an X-ray target according to an embodiment. Method 500 includes forming 502 an intermediate target cap form of substrate material having an intermediate density and a focal track layer of emitting material having an intermediate emitting material density. As used herein, "form" includes an arrangement of layers of substrate material and emitting material, irregardless of whether the arrangement is forged to desired shape. Suitable substrate materials and emitting materials were previously described above. According to one embodiment, only one of the substrate material and the emitting material is present during forming 502. The intermediate target cap form can be formed in any suitable manner. According to one embodiment, the intermediate target cap form is formed by sequentially cold pressing, sintering and forging a target cap form. As used herein, "cold pressing" means uniaxially compacting materials of a form at pressures ranging from an initial pressure to a final pressure at about ambient temperature in the presence of atmospheric air. According to an embodiment, the intermediate target cap form can be formed of the substrate material by powder metallurgy techniques, plasma spraying, electroplating, chemical vapor deposition, or physical vapor deposition, as previously described herein. According to an embodiment, the focal track layer of emitting material is formed on the front surface of the substrate material in a suitable manner, such as by powder coating or plasma spraying. As used herein, intermediate density means the density of the substrate material in the resulting intermediate target cap form formed in forming 502. As used herein, intermediate emitting material density means density of the emitting material in the resulting intermediate target cap form formed in forming 502. As previously explained above, "density" means the minimum density within the subject material.

Method 500 also includes compacting 504 the intermediate target cap form of substrate material and the focal track layer of emitting material by application of gas pressure at elevated temperature for a time period to form a final target cap form of dense substrate material having a final density greater than the intermediate density and a focal track of dense emitting material having a final emitting material density greater than the intermediate emitting material density. According to an embodiment, at least one of the substrate material and the emitting material is densified. As used herein, "densified" means that the subject material has a final density greater than a preceding intermediate density. According to one embodiment, at least one of the substrate material is dense substrate material having a final density greater than the intermediate density or the emitting material is dense emitting material having a final emitting material density greater than the intermediate emitting material density. According to one embodiment, only one of the substrate material and the emitting material is present during compacting 504. As used herein, "dense substrate material" means a dense substrate material formed in compacting 504 and which has a final density greater than the intermediate density. As used herein, "dense emitting material" means a dense emitting material formed in compacting 504 and which has a final emitting material density greater than the intermediate emitting material density. Suitable gases are inert gases or reducing gases. The ranges of gas pressure, temperature and time period may vary, as further described below.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

In one embodiment, compacting 504 includes hot isostatic pressing. As used herein, hot isostatic pressing means compacting a form of substrate material and emitting material by application of gas pressure, at homologous temperature, for a time period to form dense substrate material having a final density greater than an intermediate density and dense emitting material density having a final emitting material density greater than an intermediate emitting material density. As used herein, "homologous temperature" means the ratio, on an absolute temperature scale, of process temperature to the melting point of a material. According to one embodiment, only one of the substrate material and the emitting material is present during hot isostatic pressing. According to one embodiment, either or both of the substrate material and the emitting material are in the form of powder before compacting 504. According to one embodiment, compacting 504 includes: compacting the intermediate target cap form of substrate material and emitting material by application of gas pressure between about 35 MPa and about 500 MPa, at homologous temperature (Th) between about 0.3 of the lowest melting point component and about 0.8 of the highest melting point component, for a time period. In one embodiment, the time period ranges from at least about 1 minute to at least about 100 hours. In one embodiment, the time period ranges from at least about 1 minute to about 100 hours. In one embodiment, the time period ranges from at least about 30 minutes to about 100 hours. In one embodiment, the time period ranges from at least about 4 hours to about 100 hours. It is to be understood that the ranges of pressure, temperature and time period can vary in embodiments.

According to one embodiment, method 500 includes mechanically working 506 the final target cap form to impart work into the dense substrate material and the dense emitting material. Imparting mechanical work into the dense substrate material and dense emitting material forms or influences desired properties, such as desired grain size and more uniform grain size distribution.

According to one embodiment, method 500 also includes final machining 508 the final target cap form to predetermined dimensions.

Figure 6:
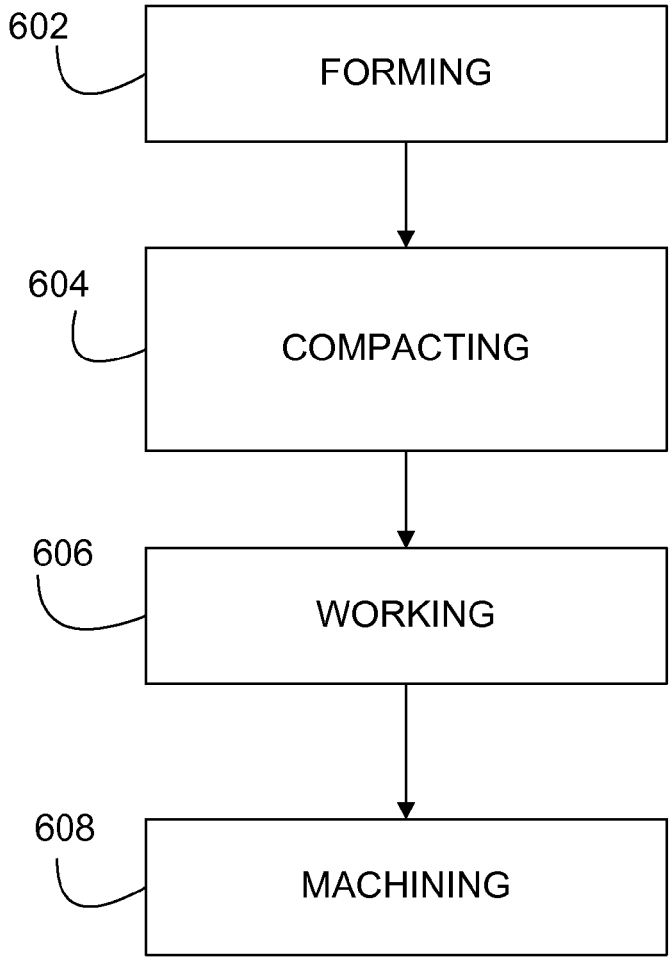
FIG. 6 is a flowchart illustrating a Method 600 for producing an X-ray target according to an embodiment.
Figure 6:
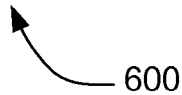

FIG. 6 is a flowchart illustrating a method 600 to manufacture an X-ray target according to an embodiment. Method 600 includes forming 602 an intermediate target cap form of substrate material having an intermediate density and a focal track layer of emitting material having an intermediate emitting material density. As used herein, "form" includes an arrangement of layers of substrate material and emitting material, irregardless of whether the arrangement is forged to desired shape. Method 600 includes compacting 604 the intermediate target cap form of substrate material and emitting material material by application of gas pressure between about 35 MPa and about 500 MPa, at homologous temperature (Th) between about 0.3 of the lowest melting point component and about 0.8 of the highest melting point component, for a time period to form a final target cap form of dense substrate material having a final density greater than the intermediate density and dense emitting material having a final emitting material density greater than the intermediate emitting material density. Suitable materials and conditions were previously described above. In an embodiment, compacting 604 includes hot isostatic pressing. Method 600 includes mechanically working 606 the final target cap form to impart work into the dense substrate material and dense emitting material. Method 600 includes final machining 608 the final target cap form to predetermined dimensions.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

Figure 7:
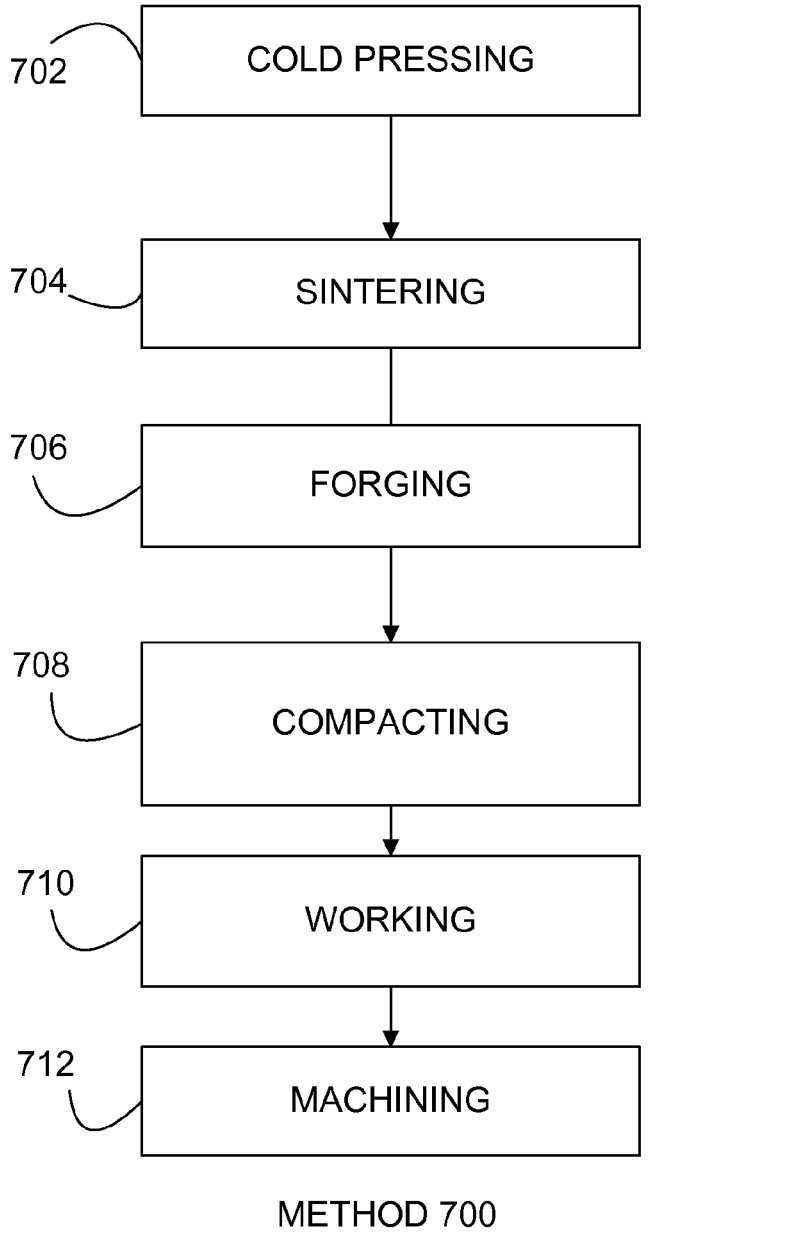
FIG. 7 is a flowchart illustrating a Method 700 for producing an X-ray target according to an embodiment.

FIG. 7 is a flowchart illustrating a method 700 to manufacture an X-ray target according to an embodiment. Method 700 includes: cold pressing 702 a target cap form of substrate material and a focal track layer of emitting material to form a pressed target cap form of pressed substrate material having a pressed density and pressed emitting material having a respective pressed emitting material density. Method 700 includes sintering 704 the pressed target cap form to form a sintered target cap form of sintered substrate material having a sintered density and sintered emitting material having a sintered emitting material density. Method 700 includes forging 706 the sintered target cap form to form a forged target cap form of forged substrate material having a forged density and forged emitting material having a forged emitting material density. Method 700 includes compacting 708 the forged target cap form of forged substrate material and forged emitting material by application of gas pressure between about 35 MPa and about 500 MPa, at homologous temperature (Th) between about 0.3 of the lowest melting point component and about 0.8 of the highest melting point component, for a time period to form a final target cap form of dense substrate material having a final density greater than the forged density and dense emitting material having a final emitting material density greater than the forged emitting material density. Suitable materials and conditions were previously described above. According to an embodiment, compacting 708 includes hot isostatic pressing. Method 700 includes mechanically working 710 the final target cap form to impart work into the dense substrate material and dense emitting material. Method 700 includes final machining 712 the final target cap form to predetermined dimensions.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

Figure 8:
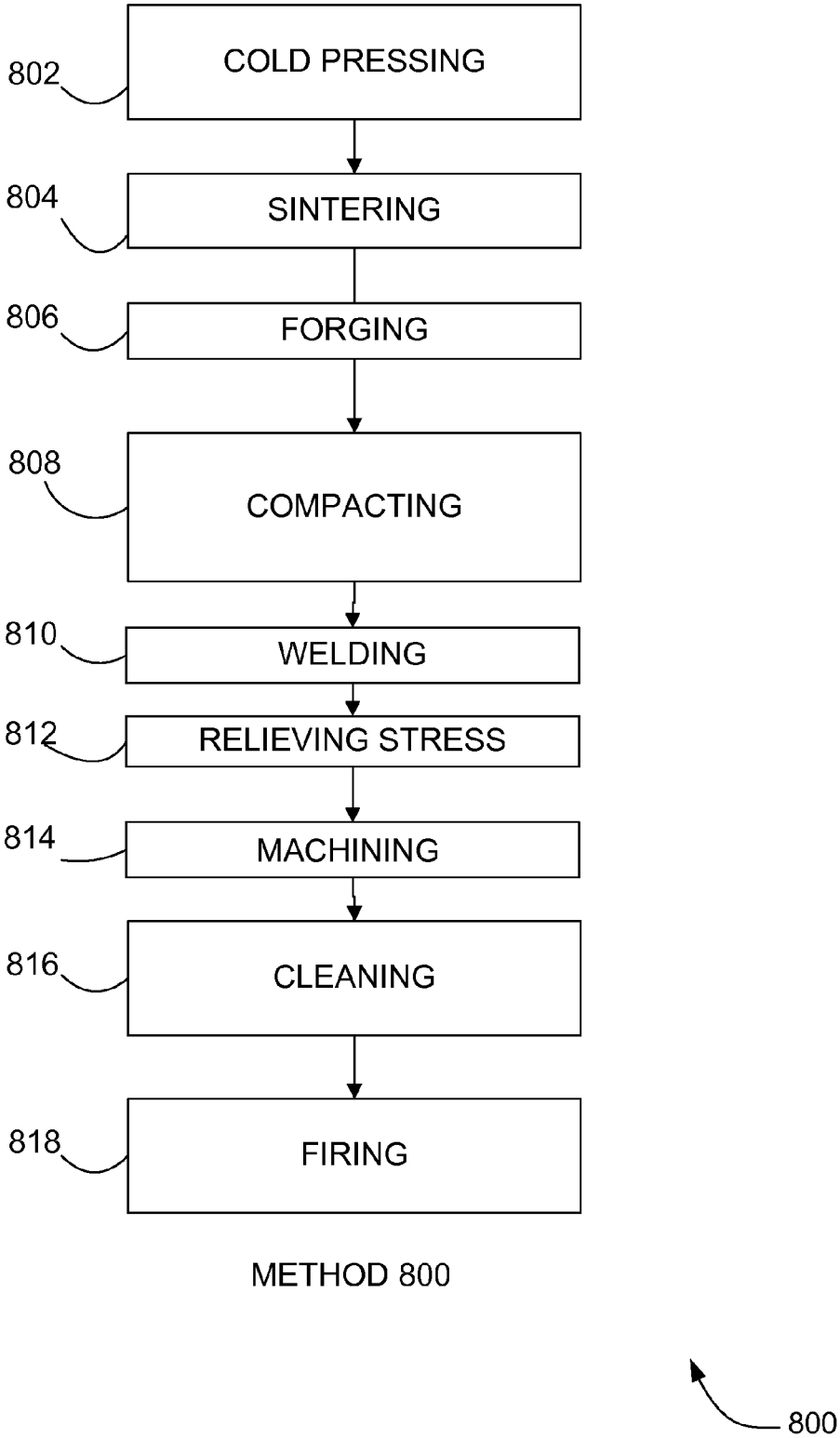
FIG. 8 is a flowchart illustrating a Method 800 for producing an X-ray target according to an embodiment.

FIG. 8 is a flowchart illustrating a method 800 to manufacture an X-ray target according to an embodiment. Method 800 includes cold pressing 802 a target cap form of substrate material and a focal track layer of emitting material to form a pressed target cap form of pressed substrate material having an initial pressed density and pressed emitting material having a respective pressed emitting material density. Method 800 includes sintering 804 the pressed target cap form to form a sintered target cap form of sintered substrate material have a sintered density and sintered emitting material having a respective sintered emitting material density. Method 800 includes forging 806 the sintered target cap form to form a forged target cap form of forged substrate material having a forged density and forged emitting material having a respective forged emitting material density. Method 800 includes compacting 808 the forged target cap form by application of gas pressure between about 35 MPa and about 500 MPa, at homologous temperature (Th) between about 0.3 of the lowest melting point component and about 0.8 of the highest melting point component, for a time period to form a final target cap form of dense substrate material having a final density greater than the forged density and dense emitting material having a respective final emitting material density greater than the forged emitting material density. Method 800 includes welding 810 the disk portion of the final target cap form to a stem. In an embodiment, welding 810 includes friction welding, inertia welding, or brazing. Method 800 includes stress relieving 812 the final target cap form. It is to be understood that, according to an embodiment, stress relieving can be performed more than once and can be performed at different or additional points in method 800. For example, stress relieving can be performed after forging 806. Method 800 includes final machining 814 the final target cap form. Method 800 includes cleaning 816 the target cap. Method 800 includes vacuum firing 818 the target cap. According to one embodiment, welding 810 is omitted when the final target cap form includes a disk portion and stem integrally formed of the dense substrate material, because further joining disk portion and stem is not required. Suitable materials and conditions were previously described above.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

Figure 9:
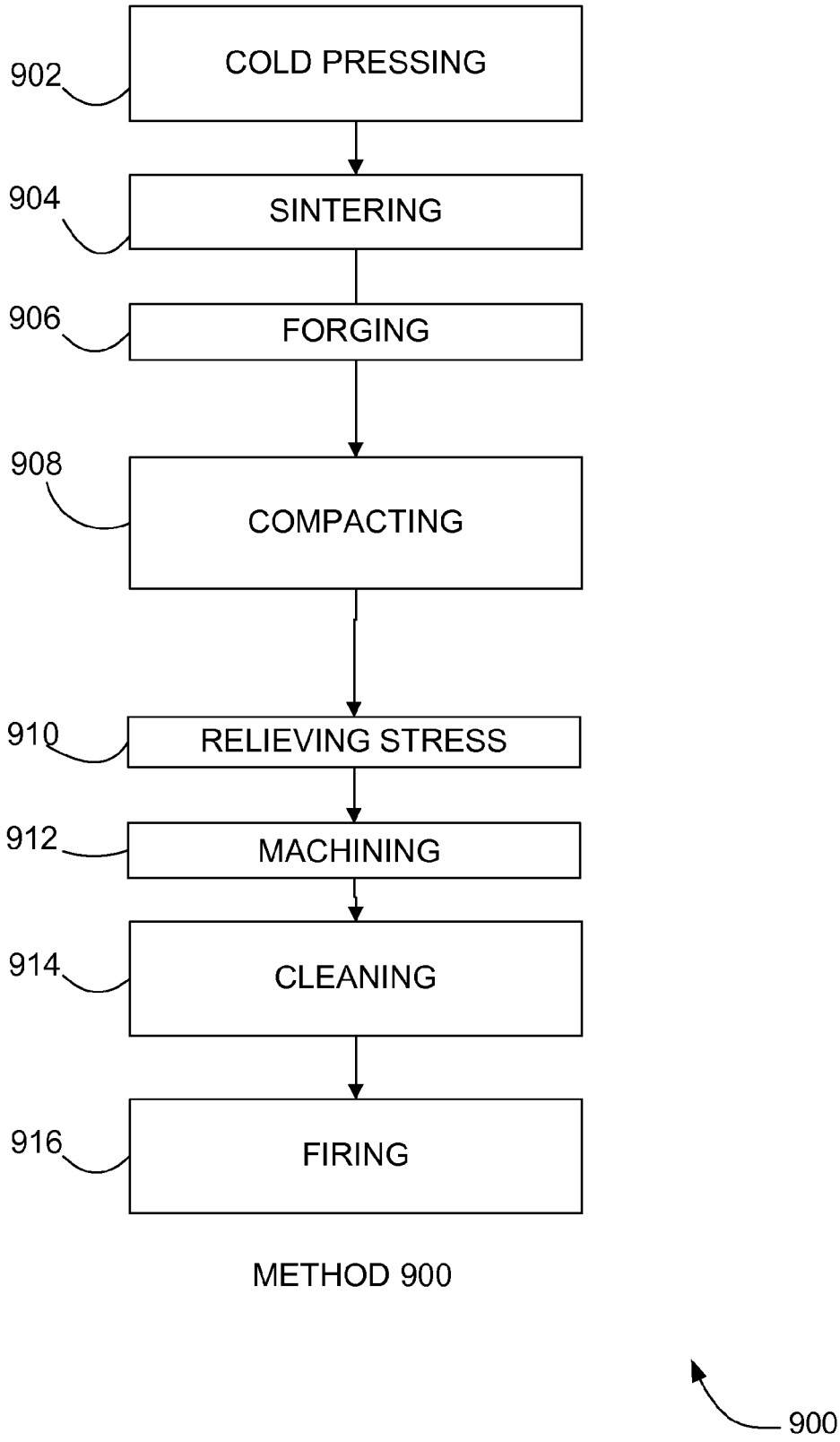
FIG. 9 is a flowchart illustrating a Method 900 for producing an X-ray target according to an embodiment.

FIG. 9 is a flowchart illustrating a method 900 to manufacture an X-ray target according to an embodiment. Method 900 includes cold pressing 902 a target cap form, the target cap form including substrate material integrally forming a stem and a disk portion, the disk portion having a front surface with an outer edge, the target cap form including a focal track layer of emitting material on the front surface, the focal track layer defining an annular focal track on the front surface adjacent the outer edge, and thus forming a pressed target cap form of pressed substrate material having a cold pressed density and pressed emitting material respectively having a cold pressed emitting material density. Method 900 includes sintering 904 the pressed target cap form to create a sintered target cap form of sintered substrate material having a sintered density and sintered emitting material having a respective sintered emitting material density. Method 900 includes forging 906 the sintered target cap form to create a forged target cap form of forged substrate material having a forged density and forged emitting material having a respective forged emitting material density. Method 900 includes compacting 908 by hot isostatic pressing the forged target cap form by application of gas pressure between about 35 MPa and about 500 MPa, at homologous temperature (Th) between about 0.3 of the lowest melting point component and about 0.8 of the highest melting point component, for a time period to form a final target cap form of dense substrate material having a final density greater than the forged density and dense emitting material having a respective final emitting material density greater than the forged emitting material density. Method 900 includes stress-relieving 910 the final target cap form. It is to be understood that, according to an embodiment, stress relieving can be performed more than once and can be performed at different or additional points in method 900. For example, stress relieving can be performed after forging 906. It is to be understood that, according to alternative arrangements wherein the final target cap form does not include a stem integrally formed of the substrate material, before stress relieving 910, the disk portion of the final target cap form is joined to a stem in a suitable manner, such as welding. According to an embodiment, welding can include, for example, friction welding, inertia welding, or brazing. Method 900 includes final machining 912 the final target cap form. Method 900 includes cleaning 914 the target cap. Method 900 includes vacuum firing 916 the target cap. Suitable materials and conditions were previously described herein.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

Figure 10:
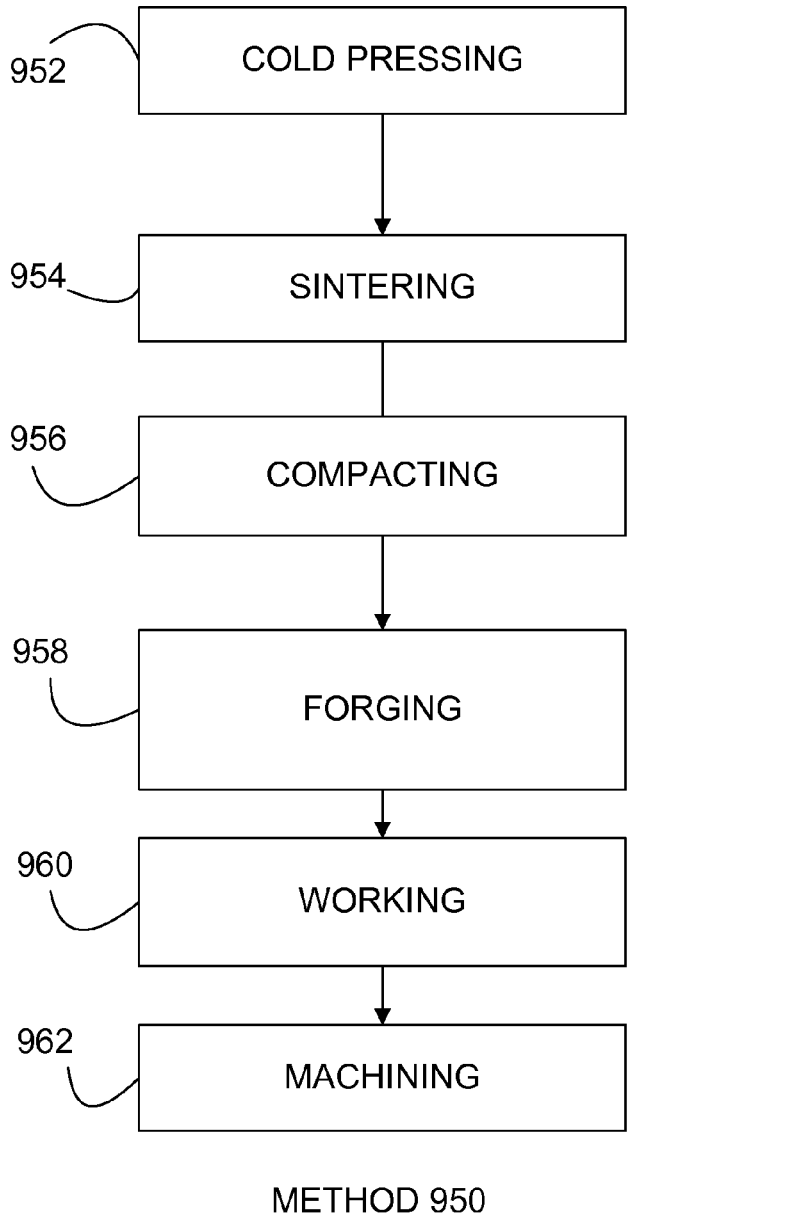
FIG. 10 is a flowchart illustrating a Method 950 for producing an X-ray target according to an embodiment.

FIG. 10 is a flowchart illustrating a method 950 to manufacture an X-ray target according to an embodiment. Method 950 includes: cold pressing 952 a target cap form of substrate material and a focal track layer of emitting material to form a pressed target cap form of pressed substrate material having a pressed density and pressed emitting material having a respective pressed emitting material density. As used herein and previously explained above, "form" includes an arrangement of layers of substrate material and emitting material, irregardless of whether the arrangement is forged to desired shape. Method 950 includes sintering 954 the pressed target cap form to form a sintered target cap form of sintered substrate material having a sintered density and sintered emitting material having a sintered emitting material density. Method 950 includes compacting 956 the sintered target cap form of sintered substrate material and sintered emitting material by application of gas pressure between about 35 MPa and about 500 MPa, at homologous temperature (Th) between about 0.3 of the lowest melting point component and about 0.8 of the highest melting point component, for a time period to form a final target cap form of dense substrate material having a final density greater than the sintered density and dense emitting material having a final emitting material density greater than the sintered emitting material density. Suitable materials and conditions were previously described above. According to an embodiment, compacting 956 includes hot isostatic pressing. Method 950 includes forging 958 the final target cap form to desired shape. Method 950 includes mechanically working 960 the final target cap form to impart work into at least one of the dense substrate material and dense emitting material. It is to be understood that working 906 can be performed to refine the dense substrate material and dense emitting material at any desired point, such as before forging 958. Method 950 includes final machining 962 the final target cap form to predetermined dimensions.

According to an embodiment, the final density of the substrate material and final emitting material density are greater than or equal to about 95.0% of theoretical density. According to an embodiment, the final density and final emitting material density are greater than or equal to about 96.0% of theoretical density. According to one embodiment, the final density and final emitting material density are greater than or equal to about 97.0% of theoretical density. According to one embodiment, the final density and final emitting material density are greater than or equal to about 98.0% of theoretical density. According to one embodiment, the final density and final emitting material density are greater than or equal to about 99.0% of theoretical density. According to one embodiment, at least one of the substrate material and the emitting material has a respective final density or final emitting material density as specified in the preceding.

CONCLUSION

X-ray targets, X-ray apparatus, and X-ray imaging systems according to embodiments of the disclosure are described. Although specific embodiments are illustrated and described herein, it will be appreciated by those of ordinary skill in the art that any arrangement which is calculated to achieve the same purpose can be substituted for the specific embodiments shown. This application is intended to cover any adaptations or variations of the embodiments and disclosure. For example, although described in terminology and terms common to the field of X-ray imaging systems, X-ray apparatus and X-ray targets, one of ordinary skill in the art will appreciate that implementations can be made for other systems, apparatus or methods that provide the required function.

In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future X-ray imaging systems, X-ray apparatus, anode assemblies, X-ray targets, target caps, different substrate materials, and different emitting materials.

Terminology used in the present disclosure is intended to include all environments and alternate technologies which provide the same functionality described herein.

We claim:

1. An X-ray apparatus for generating X-rays, the X-ray apparatus comprising:

a rotor; and an X-ray target including a target cap and a stem integrally formed of substrate material, the stem being adapted for connection to the rotor, a focal track layer on the substrate material, the focal track layer being formed of emitting material, and at least one of the substrate material and the emitting material having a minimum density greater than or equal to about 96.0% of theoretical density and a maximum density less than or equal to about 99.0% of the theoretical density.

2. The X-ray apparatus of claim 1, and further comprising:

the at least one of the substrate material and the emitting material having a minimum density greater than or equal to about 97.0% of theoretical density.

3. The X-ray apparatus of claim 2, and further comprising:

the at least one of the substrate material and the emitting material having a minimum density greater than or equal to about 98.0% of theoretical density.

4. The X-ray apparatus of claim 3, and further comprising:

the at least one of the substrate material and the emitting material having a minimum density about 99.0% of theoretical density.

5. The X-ray apparatus of claim 1, and further comprising:

wherein the substrate material includes a high conductivity refractory metal selected from molybdenum, compositions including molybdenum, alloys of molybdenum, compositions including alloys of molybdenum, tungsten, compositions including tungsten, alloys of tungsten, and compositions including alloys of tungsten.

6. An X-ray apparatus for generating X-rays, the X-ray apparatus comprising:

a rotor; and an X-ray target including a target cap and a stem integrally formed of substrate material, the stem being adapted for connection to the rotor, a focal track layer on the substrate material, the focal track layer being formed of emitting material, the substrate material having a minimum density greater than or equal to about 96.0% of theoretical density and a maximum density less than or equal to about 99.0% theoretical density.

7. The X-ray apparatus of claim 6, the minimum density further comprising:

a minimum density greater than or equal to about 97.0% of the theoretical density.

8. The X-ray apparatus of claim 6, the minimum density further comprising:

a minimum density greater than or equal to about 98.0% of the theoretical density.

9. The X-ray apparatus of claim 6, the maximum density further comprising:

a maximum density less than or equal to about 97.0% of the theoretical density.

10. The X-ray apparatus of claim 6, the maximum density further comprising: a maximum density less than or equal to about 98.0% of the theoretical density.

11. The X-ray apparatus of claim 6, the maximum density further comprising:

a maximum density about 96.0% of the theoretical density.

12. The X-ray apparatus of claim 6, the minimum density further comprising:

a minimum density about 99.0% of the theoretical density.

13. The X-ray apparatus of claim 6, wherein the substrate material includes a high conductivity refractory metal selected from molybdenum, compositions including molybdenum, alloys of molybdenum, compositions including alloys of molybdenum, tungsten, compositions including tungsten, alloys of tungsten, and compositions including alloys of tungsten.

14. An X-ray apparatus for generating X-rays, the X-ray apparatus comprising:

a rotor; and an X-ray target including a target cap and a stem integrally formed of substrate material, the stem being adapted for connection to the rotor, a focal track layer on the substrate material, the focal track layer being formed of emitting material, the emitting material having a minimum density greater than or equal to about 96.0% of a theoretical density and a maximum density less than or equal to about 99.0% of the theoretical density.

15. The X-ray apparatus of claim 14, the minimum density further comprising:

a minimum density greater than or equal to about 97.0% of the theoretical density.

16. The X-ray apparatus of claim 14, the minimum density further comprising:

a minimum density greater than or equal to about 98.0% of the theoretical density.

17. The X-ray apparatus of claim 14, the maximum density further comprising:

a maximum density less than or equal to about 97.0% of the theoretical density.

18. The X-ray apparatus of claim 14, the maximum density further comprising:

a maximum density less than or equal to about 98.0% of the theoretical density.

19. The X-ray apparatus of claim 14, the maximum density further comprising:

a maximum density about 96.0% of the theoretical density.

20. The X-ray apparatus of claim 14, the minimum density further comprising:

a minimum density about 99.0% of the theoretical density.

* * * * *